United States Patent [19]

Klingberg et al.

[11] Patent Number: 4,852,502

[45] Date of Patent: Aug. 1, 1989

[54] SAFETY BOX FOR SAFEGUARDING DOCUMENTS AND THE LIKE

[76] Inventors: Sven Klingberg, Erik Dahlbergsgatan 19, 52100 Falköping; Sixten Persson, PL 2215, 52050 Stenstorp, both of Sweden

[21] Appl. No.: 196,630

[22] PCT Filed: Jul. 16, 1987

[86] PCT No.: PCT/EP87/00386

§ 371 Date: May 13, 1988

§ 102(e) Date: May 13, 1988

[87] PCT Pub. No.: WO88/01003

PCT Pub. Date: Feb. 11, 1988

[30] Foreign Application Priority Data

Aug. 6, 1986 [DE] Fed. Rep. of Germany ..... 3627105

[51] Int. Cl.[4] ..... E05G 3/00; G08B 13/22

[52] U.S. Cl. ..... 109/25; 109/41; 109/42; 109/35

[58] Field of Search ..... 109/20, 25, 29, 31, 109/41, 42, 35, 24, 49.5

[56] References Cited

U.S. PATENT DOCUMENTS

| | | | |
|---|---|---|---|
| 181,078 | 8/1876 | Larned | 109/41 |
| 3,559,593 | 2/1971 | Munton et al. | 109/23 |
| 3,763,795 | 10/1973 | Wetz, Jr. | 109/24 |
| 3,825,920 | 7/1974 | Nelson et al. | 109/42 |
| 3,851,602 | 12/1974 | Lamping | 109/31 |
| 4,722,435 | 2/1988 | Mareels et al. | 109/25 |

FOREIGN PATENT DOCUMENTS

| | | | |
|---|---|---|---|
| 0048488 | 9/1981 | European Pat. Off. . | |
| 0166024 | 2/1986 | European Pat. Off. . | |
| 1923185 | 11/1970 | Fed. Rep. of Germany . | |
| 2441054 | 3/1976 | Fed. Rep. of Germany . | |
| 1591087 | 4/1978 | Fed. Rep. of Germany . | |
| 2382211 | 9/1978 | France . | |
| 2379870 | 10/1978 | France | 109/42 |
| 2411294 | 7/1979 | France . | |
| 656771 | 7/1986 | Switzerland . | |

*Primary Examiner*—Neill R. Wilson

*Attorney, Agent, or Firm*—Finnegan, Henderson, Farabow, Garrett & Dunner

[57] ABSTRACT

A safety box comprises a multi-layered wall having provided therein at least one conductor, which responds by interruption or short-circuiting to damage caused to the wall, and which, if the wall is damaged, activates a circuit connected to said conductor. In response to activation of said circuit, documents contained in said safety box are marked or destroyed via an ignition means. The wall of the safety box is provided with electric shield means. In order to increase the response reliability of the circuit, the invention provides the feature that the shield means is galvanically separate from the circuit.

4 Claims, 4 Drawing Sheets

SAFETY BOX FOR SAFEGUARDING DOCUMENTS AND THE LIKE

DESCRIPTION

The present invention refers to a safety box according to the generic clause of claim 1.

Such safety boxes, which are known e.g. from U.S. Pat. Nos. 3,559,593 and 3,851,602, have been used for transporting secret documents or money for a fairly long time. Such safety boxes have e.g. the form of a portfolio whose outward appearance corresponds to that of a conventional hard-shell case consisting of plastic material. The safety box wall, which is in most cases fabricated of metal or of plastic material, is normally provided with a large number of conductors extending in the wall of the safety box in a close-meshed pattern and connected to a detection circuit. If an unauthorized person tries to open the safety box by force by destructing the wall of the safety box, he will, in so doing, either break through one of the conductors or cause a short circuit between neighbouring conductors. This condition deviating from the normal condition can be detected by the detection circuit, which triggers an actuation signal. Said actuation signal is normally used for activating an alarm means on the one hand and, on the other hand, it is used for permanently destructing or for marking the documents or bank-notes contained in the safety box. In most cases, this is effected by igniting an explosive charge with the aid of said actuation signal, said explosive charge being used for ejecting from a reservoir an acid or a marking liquid and for spreading said acid or marking liquid over the documents and bank-notes, respectively. This means that, if someone tries to break open the safety box, the bank-notes or documents contained in said safety box will either be marked permanently by a colouring agent, or they will be fully dissolved by an acid, this being desirable in particular in the case of secret documents.

The major part of the known, commercially available safety boxes is provided with a wall of plastic material in which the conductor is embedded, said conductor being normally constructed as a conductor lattice. However, due to electrostatic charging of the box wall, undesirable activation of the circuit may occur in the case of such safety boxes so that unintentional marking or destruction of the bank-notes or documents transported may be effected also in cases in which the wall of the safety box has not been damaged. Moreover, it may happen that stray fields acting on the safety box from outside cause a voltage induction in the conductor located within the wall, and this, too, may result in faulty activation of the circuit.

Furthermore, there are safety boxes, which, for increasing the impact resistance of the safety box wall, are provided with a wall fabricated of metal. In the case of these safety boxes, the earth terminal of the safety circuit is connected to the metal box wall. Due to the complete shielding of the conductor, which responds to interruption and short-circuiting, respectively, in the case of a destruction of the wall, unintentional activation caused by external stray fields will not occur in the case of this type of boxes. It may, however, happen that, by applying voltages to the metal wall of the safety box, the detection circuit can be destructed or manipulated in such a way that a subsequently following destruction of the wall will not cause the circuit to produce an actuation signal. The safety boxes which are nowadays predominantly used have a non-shielded, insulated plastic wall.

In comparison with this prior art, the present invention is based on the task of further developing a safety box of the type mentioned at the beginning in such a way that the reliability with which the circuit detects a destruction of the safety box wall is further increased.

In the case of a safety box of the type mentioned at the beginning, this task is solved by the feature disclosed in the characterizing clause of claim 1.

In accordance with the invention, the safety box is provided with a shield means, said shield means being, however, galvanically separate from the circuit. Due to the fact that the connection between the housing mass and the circuit mass—which is normally provided in the field of circuit technology—has been omitted, it has become possible to combine the immunity to induction fields, which is a characteristic of metal safety boxes according to the prior art, with the protection against manipulations, which, up to now, has only been achieved by safety boxes consisting of plastic material and having an insulated wall. The measure according to the invention permits a substantial increase in the obtainable reliability in detecting a destruction of the wall of the safety box, without any additional expenditure in the field of circuit technology being necessary.

Preferred embodiments are disclosed in the subclaims.

In the following, a preferred embodiment of the safety box according to the invention will be explained in detail while making reference to the accompanying drawings, in which.

Figure 1:
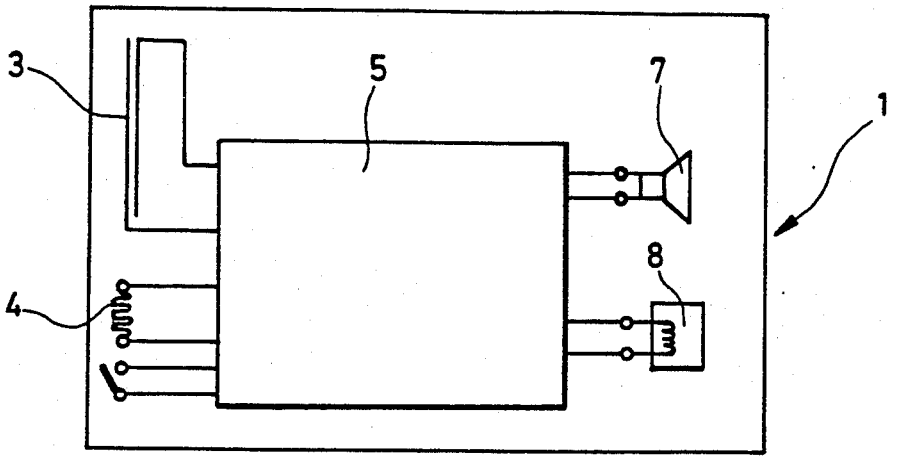
FIG. 1 shows a block diagram of a circuit for a safety box.

As can be seen in FIG. 1, a safety box 1 according to the invention is provided with a shield means 2 enclosing at least the safety box wall portions in which conductors 3, 4 extend, said conductors responding to damage to the wall by causing a short circuit or an interruption.

A conductor which responds to damage to the wall by causing a short circuit is provided with reference numeral 3 and is schematically shown in FIG. 1. In the practically realized embodiment, this conductor is formed by two conductor sections extending closely adjacent each other, said conductor sections being insulated from each other and, normally, twisted relative to each other. Damage to the wall in the areas of this twin conductor 3 will inevitably result in a connection of the two conductors.

The conductor can also be a conductor responding to an interruption, this type of conductor being provided with reference numeral 4. This conductor indicates damage to the wall by an interruption between its two connecting terminals. Furthermore, the safety box is provided with at least one closer switch 6 indicating unauthorized opening of the safety box without destruction of the wall.

The two conductors 3, 4 as well as the closer switch 6 are connected to a circuit 5 actuating an ignition means 8 in response to short-circuiting of the conductor 3 or interruption of the conductor 4 or in response to an actuation of the closer switch 6.

Such detection circuits are known per se in the prior art so that a more detailed explanation of these circuits, which are, in principle, very simple, an be dispensed with. Only by way of example, reference can be made to the cited U.S. Patent Nos. 3,559,593 as well as 3,851,602.

When the wall is destructed by force, such destruction being detected e.g. by an interruption of the conductor 4, the detection circuit 5 activates the ignition means 8 with the aid of which a liquid reservoir containing a marking colour or an acid is acted upon, in a manner known per se, by a propellant or a weak explosive charge so that the marking liquid or the acid in the interior of the safety box is spread over the documents or bank-notes contained in the interior of said safety box.

The shield means 2 is not galvanically connected to the mass of the circuit 5. Although the shield means 2 has the effect that undesirable induction influences cannot occur at the conductors 3, 4, the galvanic separation of the shield means 2 from the mass of the circuit 5 eliminates the possibitity of manipulating the circuit 5 by applying a voltage to said shield means 2.

Figure 2:
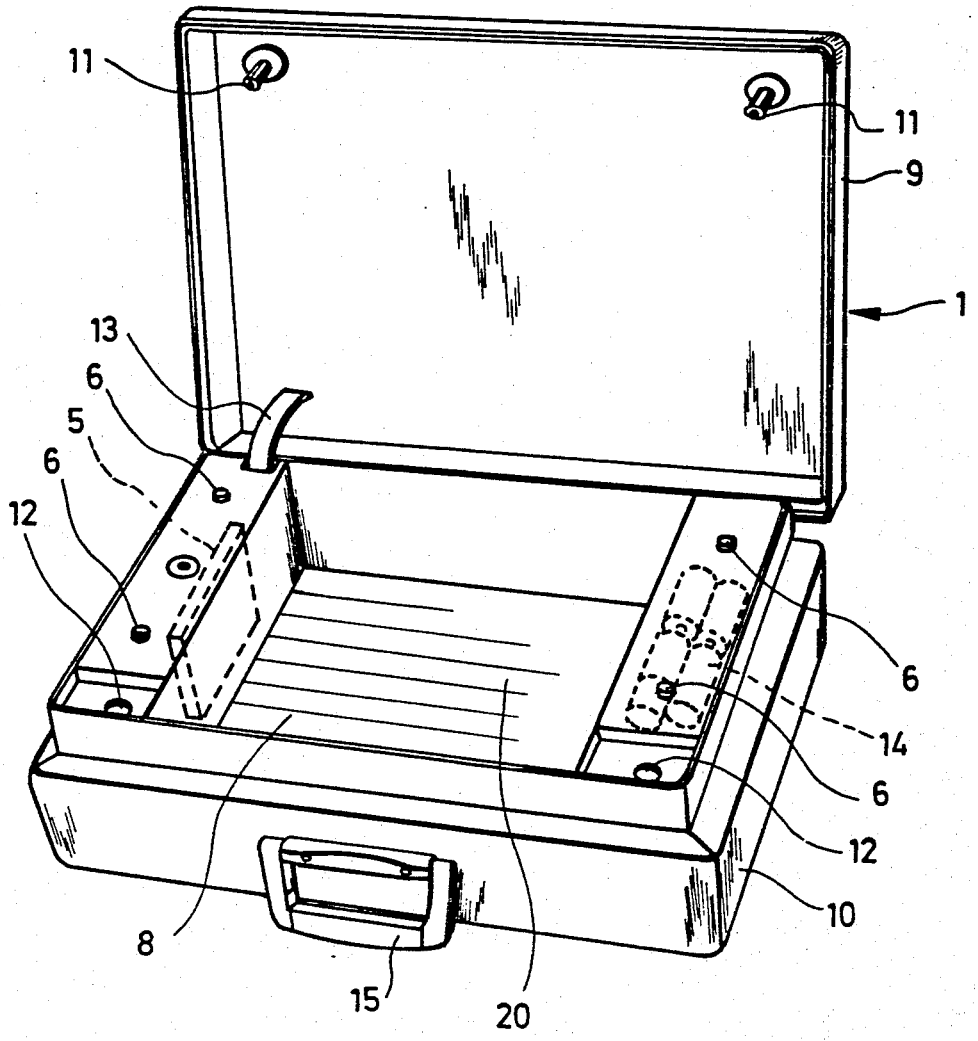
FIG. 2 shows a perspective view of an open safety box.

FIG. 2 shows a perspective view of the safety box 1 whose cover 9 is pivoted away from the base member 10 into the open position. The cover 9 has provided thereon snap-in members 11, which are adapted to be actuated by keys and which guarantee safe closure of the cover 9 by an engagement with countermembers 12 in the closed condition of the safety box 1. The base member 10 of the safety box has provided therein several closer switches 6 whose output signals indicate whether or not the cover 9 is closed. An electric connection between the cover 9 and the base member 10 for the conductors 3, 4, which extend in said cover and in said base member, is established by a flat cable 13. The circuit 5 is located in a lateral recess of the base member 10. A battery pack is secured in position in an additional recess. The base member 10 has additionally attached thereto a carrying handle 15.

The detection circuit 5 can be electrically connected to the snap-in members 11, which are adapted to be actuated by keys, so as to detect an actuation of locks of said snap-in members 11. In the case of a preferred embodiment, the detection circuit 5 is provided with a time-delay circuit (not shown) which is activated by an actuation of one of the two snap-in members, i.e. by unlocking the lock associated with said snap-in member. If, within the period of time determined by the time-delay circuit, the otehr snap-in member is unlocked by actuation of the lock associated therewith, the time-delay circuit is reset. If this is not the case, the actuation signal will be produced, whereupon the ignition means 8 is activated.

Furthermore, an acoustic alarm means may be provided, which, after actuation of the lock associated with the first snap-in member 11, produces a signal informing the operator on the basis of the nature of the acoustic signal whether the detection circuit is ready for operation. Possible malfunctions are thus excluded.

Figure 5:
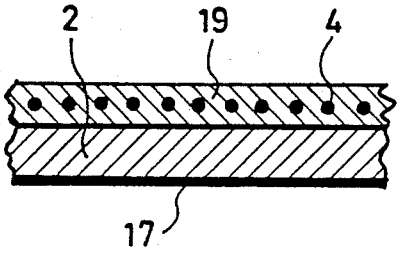
FIG. 5 shows a cross-sectional view of a wall portion of the safety box.
Figure 3:
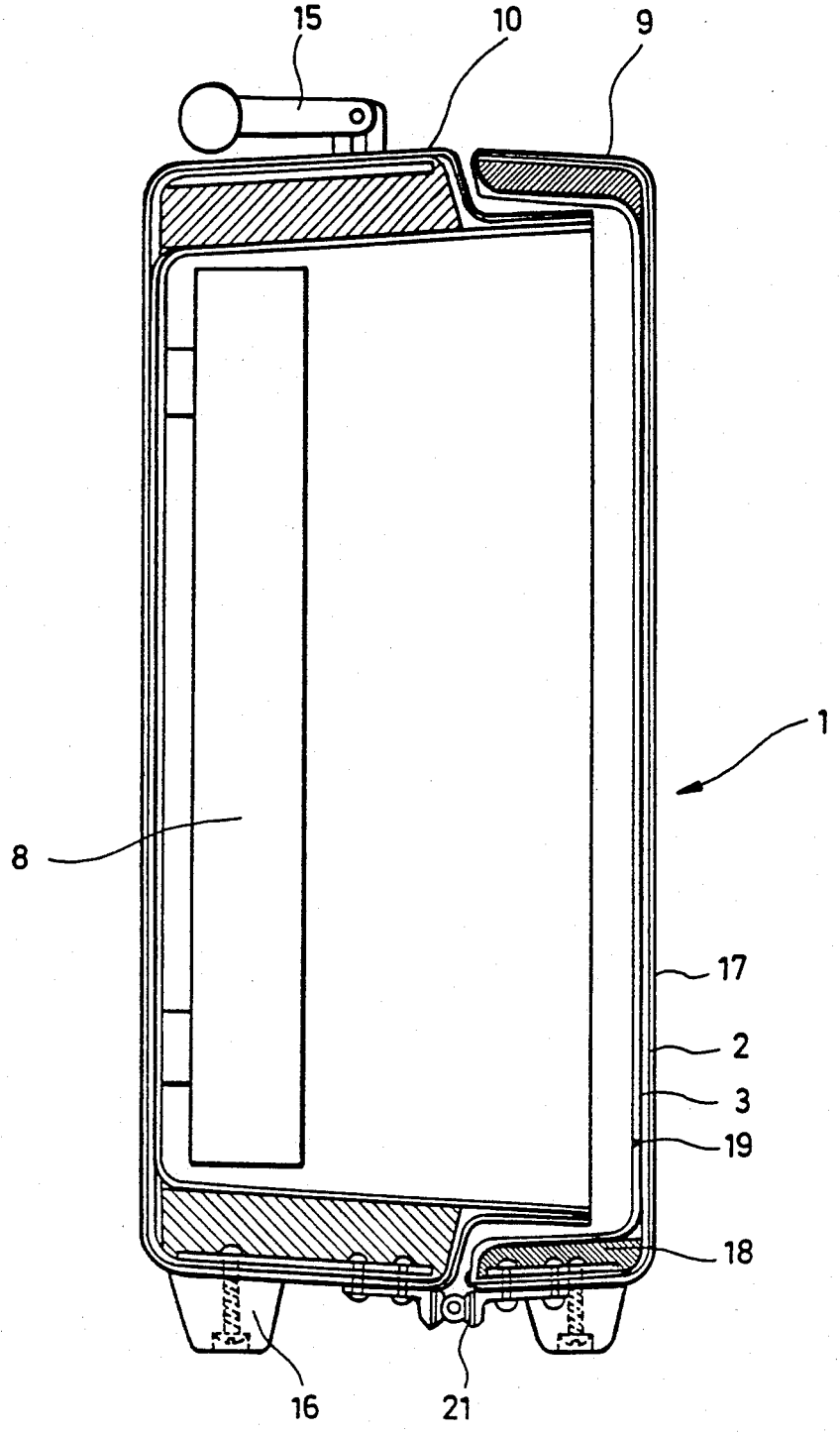
FIG. 3 shows a cross-sectional view of the safety box shown in FIG. 2, in the closed condition of said safety box.
Figure 4:
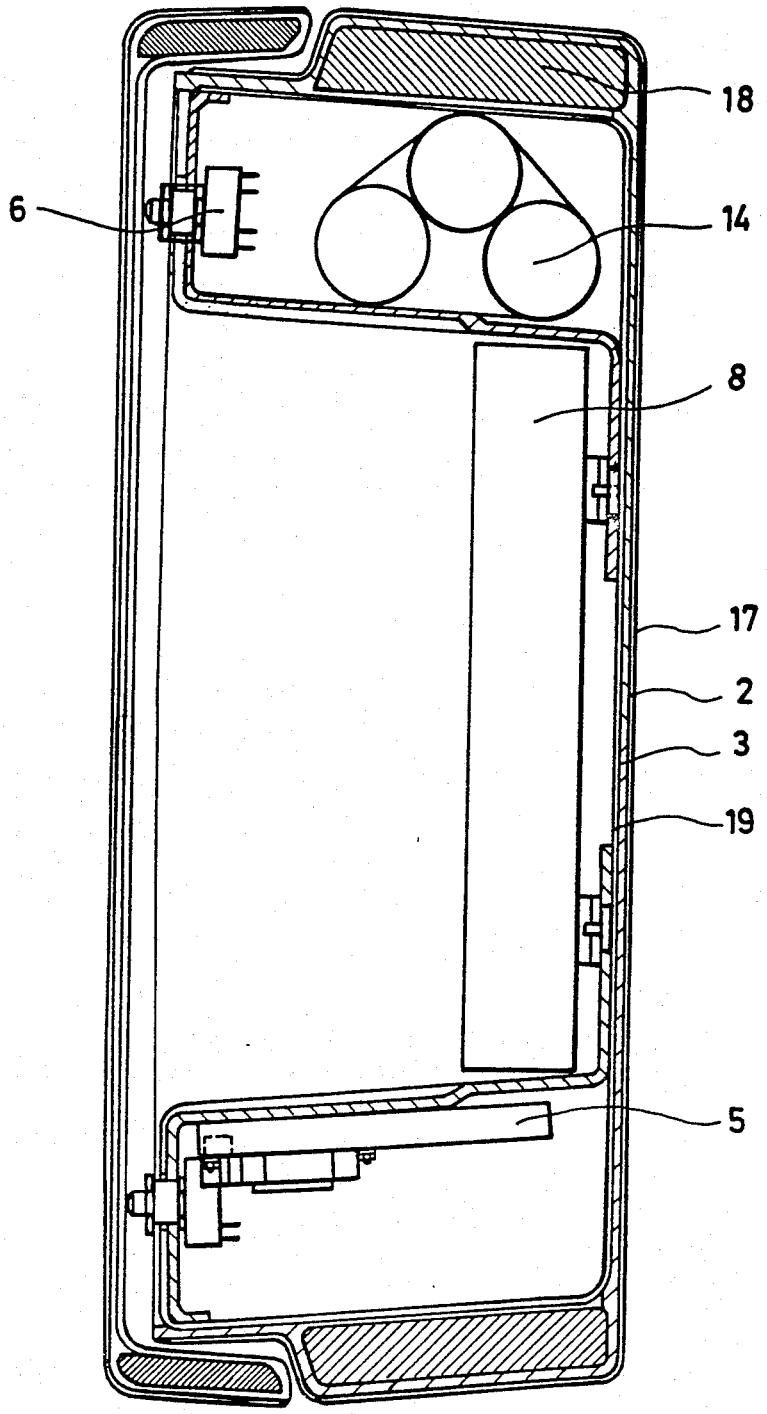
FIG. 4 shows a representation of a longitudinal section through said safety box.

As can be seen in the longitudinal and cross-sectional views of the safety box 1 according to FIG. 3 and 4 and especially in the enlarged sectional view of the wall structure of the safety box 1 according to FIG. 5, the wall of the safety box comprises an outer layer 17, which consists of an imitation leather material or of a plastic material having a leatherlike surface, a shield means 2, which follows said layer and which may consist of an aluminium foil, of a layer of aluminium powder applied by spraying on, or of a conductive colour, and a layer of glass-fibre reinforced plastic material 19 having embedded therein the conductors 3 and/or 4. The conductors 3, 4 preferably have the structure of an extremely dense conductor network, which may be constructed as a conductor lattice or in the form of an irregular conductor layer. Modifying the wall structure shown in FIG. 5, it is also possible to construct the shield means 2 in such a way that it is by far thinner than the wall of glassfibre reinforced plastic material 19. Another possibility is the possibility of constructing the wall of the glassfibre reinforced plastic material 19 such that it comprises two shells, the conductor 3, 4 being then positioned between the two shells of glass-fibre reinforced plastic material 19.

As can be seen especially in FIG. 3 and 4, marginal portions of the cover 9 and of the base member 10 are reinforced with bodies of rigid foam material 18.

The shield means 2 is galvanically connected to the handle 15 and to the foot members 16. The shield mean 2 is, also electrically, connected to joints 21 consisting of a conductive material, such a metal. Also the handle 15 and the foot members 16 are preferably fabricated of metal and represent conductive connections. On the basis of these parts, if is possible to dissipate any charges from the shield means 2 as soon as the safety box 1 is either set up on the floor or carried by an operator making use of the handle.

As shown in FIG. 3 and also in the sectional view according to FIG. 4, which is perpendicular with regard to FIG. 3, the ignition means 8 is located in the interior of the safety box, said ignition means 8 being connected to the circuit 5. The ignition means contains a propellant or explosive charge responding to the actuation signal from the electric circuit 5 and spreading a marking liquid or acid over documents deposited in the safety box. Referring again to FIG. 2, it is possible to discern schematically shown slot nozzles 20 which are provided in the ignition means 8 and which discharge the marking liquid or the acid in the case of actuation.

The outward appearance of the safety box 1 is preferably that of a conventional portfolio so that the person carrying the safety box 1 remains unrecognized and thus unendangered.

Deviating from the embodiment described, in the case of which the shield means 2 is formed by a thin, metal-foil-like shielding layer, the shield means 2 can also consist of a housing of metal plates.

We claim:

1. A safety box comprising a wall having provided therein at least one conductor, which is either interrupted or short-circuited with an additional conductor if damage is caused to said wall, and further comprising a shield means, which is located within said wall and which surrounds the wall portion through which said conductor extends, and still further comprising a circuit responding to the interruption or the short-circuiting of said conductor and used for producing an actuation signal for actuating a means for effecting changes in documents contained in the safety box, characterized in that the shield means is galvanically separate from the circuit.

2. A safety box according to claim 1, characterized in that the shield means is a metal foil embedded in said wall.

3. A safety box according to claim 1, characterized in that the shield means is a metal lattice embedded in said wall.

4. A safety box according to any one of the claims 1 to 3, characterized in that the shield means is connected to electrically conductive parts, which are each arranged on an exterior surface of the safety box.

* * * * *